US005148183A

United States Patent [19]

Aldama

[11] Patent Number: 5,148,183

[45] Date of Patent: Sep. 15, 1992

[54] FOUR-WAY ANTENNA

[75] Inventor: Alfredo Aldama, Miami, Fla.

[73] Assignee: Algira Primo Inc., Brooklyn, N.Y.

[21] Appl. No.: 532,036

[22] Filed: Jun. 1, 1990

[51] Int. Cl.[5] ..... H01Q 21/00

[52] U.S. Cl. ..... 343/853; 343/893; 343/713; 343/705

[58] Field of Search ..... 343/853, 713, 715, 850, 343/855, 893, 705

[56] References Cited

U.S. PATENT DOCUMENTS

| | | | |
|---|---|---|---|
| 2,495,748 | 1/1950 | Matson | 250/33 |
| 3,747,111 | 7/1973 | Fletcher et al. | 343/725 |
| 3,911,441 | 10/1975 | Stein | 343/725 |
| 3,950,754 | 4/1976 | Toman | 343/108 |
| 4,329,690 | 5/1982 | Parker | 343/709 |
| 4,559,539 | 12/1985 | Markowitz et al. | 343/725 |
| 4,823,140 | 4/1989 | Shibata et al. | 343/713 |

FOREIGN PATENT DOCUMENTS 0350308 1/1990 European Pat. Off. .

*Primary Examiner*—Rolf Hille
*Assistant Examiner*—Hoanganh Le
*Attorney, Agent, or Firm*—Kenyon & Kenyon

[57] ABSTRACT

There is disclosed herein a four-way antenna system having a hollow antenna body to which four antennae are attached and which can be mounted on the outside of a land, sea or air transport vehicle. The first antenna, mounted on the top of the antenna body, receives radio signals. The second antenna, also mounted on the top of the antenna body, receives VHF signals. The third antenna, mounted on the side of the antenna body, receives and transmits telephone signals. The fourth antenna, also mounted on the side of the antenna body, receives and transmits CB signals. An aluminum reflector is attached to the antenna body to reduce no interference between CB amd VHF signals. The four antennae are attached to the antenna body in such a manner that interference between all the incoming and outgoing signals are minimized. In addition, the entire system is small and compact, and can be easily mounted on the outside of any land, sea, or air transport vehicle.

10 Claims, 2 Drawing Sheets

FOUR-WAY ANTENNA

BACKGROUND OF THE INVENTION

This invention relates to antenna systems. More particularly the invention is directed to a four-way antenna system for use on automobiles, ships, airplanes, and other means of transportation on land, sea, and air for receiving VHF and radio signals, and for sending and receiving telephone and CB signals.

Antenna mounting systems are known. U.S. Pat. No. 2,495,748 describes an antenna mounting system for supporting an antenna below an airplane. In addition, multiple antenna-mounting systems are known. U.S. Pat. No. 3,747,111 describes a composite antenna feed subsystem concentrated in a small area at the prime focus of the parabola of a satellite parabolic reflector which accommodates a plurality of frequency bands. U.S. Pat. No. 3,911,441 describes a 3-way multipurpose antenna system for a radar antenna, a satellite communications antenna, and an electronic countermeasure antenna for use on a submarine. U.S. Pat. No. 3,329,690 describes a multiple antenna system for a Global Positioning System antenna, a Tactical Air Navigator antenna, and a Joint Tactical Information Distribution System antenna for use on a ship mast and U.S. Pat. No. 4,599,539 describes a spiral antenna system which is deformed to received one or more other antennas.

A problem with all of these antenna-mounting systems is that they do not provide multiple antennas which receive, and in some instances send, electromagnetic signals of different frequencies arranged in a small, compact configuration for easy mounting and use on land, sea, or air transport vehicles.

OBJECTS AND SUMMARY OF THE INVENTION

An object of the present invention is to provide a multipurpose antenna system for land, sea and air transport vehicles which combines a plurality of antennas in a compact configuration for receiving and/or transmitting electromagnetic signals of various frequencies.

Another object of the present invention is to provide a compact four-way antenna system for land, sea and air transport vehicles for receiving VHF and radio signals, and for sending and receiving CB and telephone signals.

Another object of the present invention is to provide a compact four-way antenna system for land, sea, and air transport vehicles for sending and receiving VHF, radio, CB and telephone signals in which the four antennae are mounted so that the signals the antennae are intended to pick up and receive do not interfere with one another.

BRIEF DESCRIPTION OF THE DRAWINGS

Above-mentioned and other and objects of this invention will become more apparent by reference to the following descriptions taken in conjunction with the accompanying drawings, in which.

DETAILED DESCRIPTION OF THE PREFERRED EMBODIMENT

Figure 1:
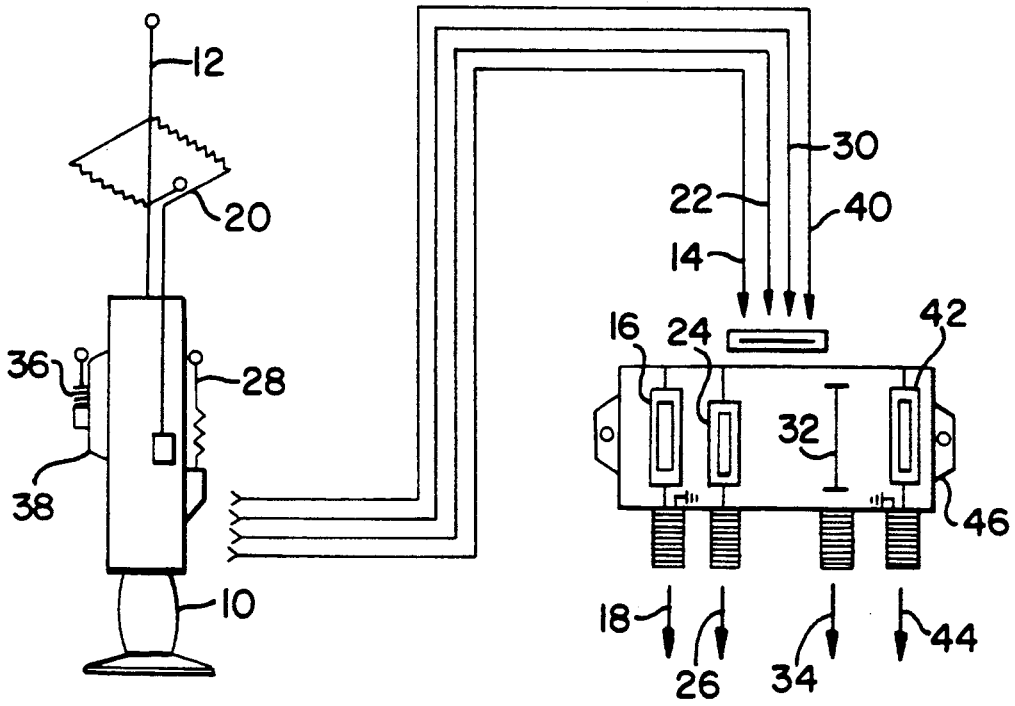
FIG. 1. illustrates a diagrammatic view of a four-way antenna system constructed in accordance with the principles of the invention.

FIG. 1 illustrates a compact four-way antenna system, which embodies the present invention, that can be mounted on land, air and sea transport vehicles; and which is capable of receiving radio and VHF signals, and sending and receiving telephone and CB signals. The frequency ranges typically associated with the signals are:

| Signal | Frequency Range |
|---|---|
| Radio | 525–1700 kHz (AM)<br>88–108 MHz (FM) |
| VHF | 30–300 MHz |
| Telephone | 3–5 kHz |
| CB | 26–28 MHz |

The four antennae 12, 20, 28, and 36 are configured with antenna body 10 in such a manner that signal interference is minimized. The signals associated with each of the four antennae 12, 20, 28 and 36 are separately transmitted through conducting wires 14, 22, 30, and 40 respectively to a distributor box 46. The four conducting wires are all contained within a single conducting cable. Signal modulation takes place within distributor box 46. Distributor box 46 may be located inside the vehicle in an accessible location, preferably in the front of the vehicle. One location for the distributor box is the front of the dashboard. An alternative location for the distributor box is underneath the dashboard. Each signal is then transmitted to a corresponding connector 18, 26, 34 and 44 for connection to a radio, VHF, telephone and CB receiver respectively.

In FIG. 1 radio antenna 12 is a steel antenna which is attached to the top of antenna body 10 and connected to conducting wire 14 inside antenna body 10. Conducting wire 14 leads into distributor box 46. In distributor box 46 conducting wire 14 leads into resistor 16, (e.g., 25 watt, 7.5 ohm). Resistor 16 is electrically connected to 50 ohm co-axial cable 18 and grounded. Grounded coaxial cable 18 can then be electrically connected to a radio receiver.

Figure 2:
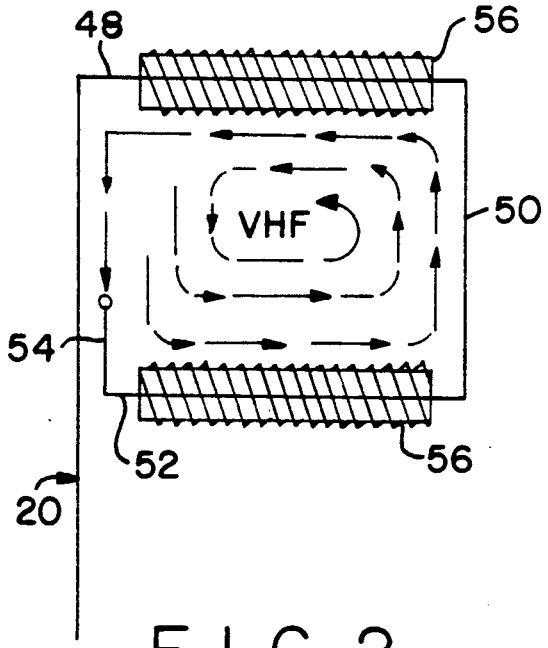
FIG. 2 is an enlarged diagrammatic view of the VHF antenna forming part of the antenna system.
Figure 4A:
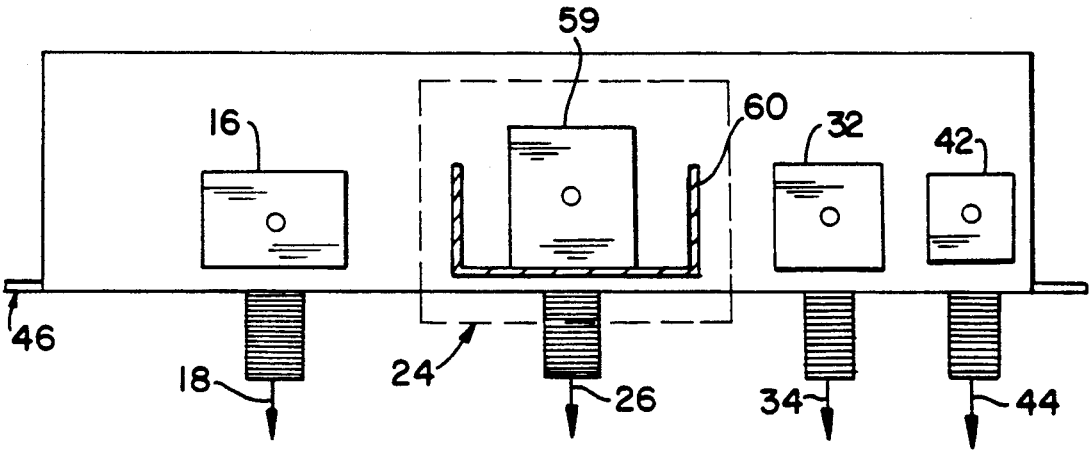
FIG. 4A is an enlarged diagrammatic view of the distributor box of the antenna system.
Figure 4B:
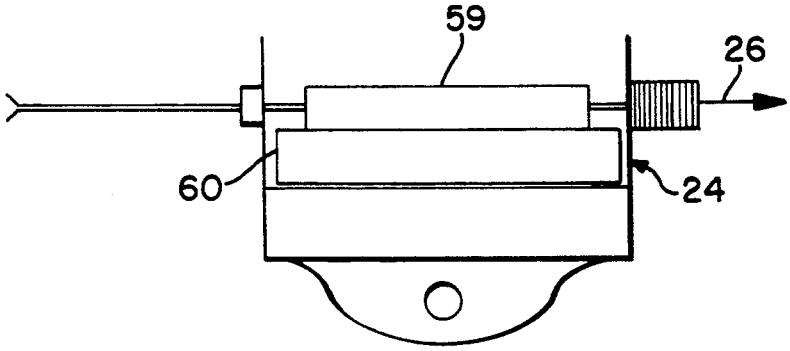
FIG. 4B is an enlarged diagrammatic view of the protector of the antenna system.

In FIG. 1 VHF antenna 20 is attached to the top of antenna body 10 and connected to conducting wire 22 inside antenna body 10. As illustrated in FIG. 2, the signal receiving end of VHF antenna 20 is bent at substantially right angles to form an open square with sides 48, 50, 52, 54 for improved reception. Sides 48 and 52 of VHF antenna 20 have 0.5 mm aluminum wire 56 continuously wrapped helically around them along their length approximately 25 times to increase resistance. VHF antenna 20 is connected to conducting wire 22 which leads into distributor box 46. In distributor box 46 conducting wire 22 leads into a protector 24 to prevent interference between VHF signals and other incoming signals. As illustrated in FIGS. 4A and 4B, the protector 24 is a plastic cover 59 which in turn is covered by a larger zinc cover 60 the walls of which are congruent with the walls of the plastic cover 59, but do not touch the plastic cover 59. The conducting wire 22 is electrically connected to a single wire 26, (e.g. 12 volts no ground), for electrical connection to a VHF receiver.

In FIG. 1 telephone antenna 28 is a steel antenna which is attached to the side of antenna body 10 and connected to conducting wire 30 inside antenna body 10. Conducting wire 30 leads into distributor box 46. In distributor box 46 conducting wire 30 leads into a protector 32 to prevent telephone interference. Conducting wire 30 is electrically connected to a single wire with no ground 34, for electrical connection to a telephone.

Figure 3:
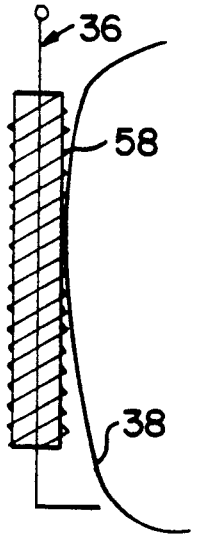
FIG. 3 is an enlarged diagrammatic view of the CB antenna and associated reflecting aluminum plate forming part of the antenna system.

In FIG. 1 CB antenna 36 is a steel antenna which is attached to the side of housing unit 10 opposite the side where telephone antenna 28 is attached. CB antenna 36 is mounted adjacent to an aluminum reflecting plate 38 which serves as a reflector to shield or separate the VHF and CB antennae to prevent electrical interference. Aluminum reflecting plate 38 prevents signals from different antennae from becoming co-mingled. As illustrated in FIG. 3 CB antenna 36 is a steel antenna which has 1.5 mm copper wire 58 helically wrapped around it along its length approximately 17 times to improve the performance of the antenna by absorbing any electrical discharge from adjacent antennae. CB antenna 36 is connected to conducting wire 40 inside antenna body 10. Conducting wire 40 leads into distributor box 46. In distributor box 46 conducting wire 40 leads into a 25 watt 7.5 ohm resistor 42. Resistor 42 is electrically connected to 50 ohm co-axial cable 44 which has a ground. Coaxial cable 44 with ground can then be electrically connected to a CB transmitter and receiver.

A a preferred embodiment of the invention is a four-way antenna of the following dimensions: an antenna body 10 that is 4 inches high including a base that is 1.5 inches high and ¾ of an inch in diameter; a radio antenna 12 that extends 5 inches above the top of antenna body 10; a VHF antenna 20 that extends 5 inches above the top of the antenna body 10; the signal receiving end of VHF antenna 20, is an open square formed by bending VHF antenna 20 at one end, is 1¾ inches long; a telephone antenna 28 attached to the side of antenna body 10 that is 3 inches long; a CB antenna 36 attached to the side of antenna body 10 that is 2 inches long, and; a rectangular aluminum reflector plate 38 adjacent to CB antenna 36 with two sides that are 1½ inches long and two sides that are ¾ of an inch long.

What is claimed is:

1. A three-way antenna system comprising:

an antenna body having a top and at least one side;

a first antenna mounted at the top of said antenna body for receiving VHF signals with an electromagnetic frequency of 30 to 300 MHz;

a second antenna and a third antenna selected from the group consisting of:

a radio antenna mounted at the top of said antenna body for receiving signals with an electromagnetic frequency of 525 to 1700 kHz and 88 to 108 MHz, a telephone antenna mounted on the side of said antenna body for sending and receiving signals with an electromagnetic frequency of 3 to 5 MHz, and a CB antenna mounted on the side of said antenna body for sending and receiving signals with an electromagnetic frequency of 26 to 28 MHz;

means for transmitting said electromagnetic signals received by said first, second and third antennae between said antennae and first, second and third receivers, the first, second and third receivers corresponding to the first, second and third antennae, respectively, wherein said means for transmitting includes a distributor box coupled between said antennae and the receivers; and means for isolating said antennae from each other so that there is no interference between said electromagnetic signals sent and received from each of said antennae.

2. The invention in accordance with claim 1 wherein the first antenna for receiving VHF signals is a straight antenna with a signal receiving end that has been bent at right angles to form an open square at the signal receiving end of the antenna.

3. The invention in accordance with claim 2 wherein two sides of the square portion of the first antenna have an aluminum wire continuously wrapped around them along their length.

4. The invention in accordance with claim 1 wherein the CB antenna has a copper wire helically wrapped around it along its length.

5. The invention in accordance with claim 2 wherein said CB antenna is mounted adjacent to an aluminum reflecting plate.

6. A four-way antenna system comprising:

an antenna body having a top and at least one side;

a first antenna mounted at the top of said antenna body for receiving radio signals with an electromagnetic frequency of 525 to 1700 kHz and 88 to 108 MHz;

a means for transmitting said radio signals from the first antenna to a distributor box;

a means for transmitting said radio signals from said distributor box to a radio receiver;

a second antenna mounted at the top of said antenna body for receiving VHF signals with an electromagnetic frequency of 30 to 300 MHz;

a means for transmitting said VHF television signals to said distributor box;

a means for transmitting said VHF signals from said distributor box to a television receiver;

a third antenna mounted on the side of said antenna body for sending and receiving telephone signals with an electromagnetic frequency of 3 to 5 MHz;

a means for transmitting said telephone signals to said distributor box;

a means for transmitting said telephone signals between said distributor box and a telephone;

a fourth antenna mounted on the side of said antenna body for sending and receiving CB signals with an electromagnetic frequency of 26 to 28 MHz;

a means for transmitting said CB signals to said distributor box;

a means for transmitting said CB signals between said distributor box and a CB receiver;

a means for isolating said antennae from each other so that there is no electrical interference between said electromagnetic signals sent and received from each of said antennae.

7. The invention in accordance with claim 6 wherein the antenna for receiving VHF signals is a straight antenna with a signal receiving end that has been bent at right angles to form an open square at the signal receiving end of the antenna.

8. The invention in accordance with claim 7 wherein two sides of the square portion of the antenna have an aluminum wire continuously wrapped around them along their length.

9. The invention in accordance with claim 6 wherein the antenna for sending and receiving CB signals has a copper wire helically wrapped around it along its length.

10. The invention in accordance with claim 6 wherein said CB antenna is mounted adjacent to an aluminum reflecting plate.

* * * * *

UNITED STATES PATENT AND TRADEMARK OFFICE

CERTIFICATE OF CORRECTION

PATENT NO. : 5,148,183

DATED : September 15, 1992

INVENTOR(S) : Aldama

It is certified that error appears in the above-identified patent and that said Letters Patent is hereby corrected as shown below:

In the Abstract, line 12, delete "no"

Column 1, line 23, change "3,329,690" to --4,329,690--;

Column 1, line 28, change "4,599,539" to --4,559,539--;

Column 1, line 57, change "other" to --other features--;

Column 2, line 21, change "3 - 5 kHz" to --824 - 894 MHz--;

Column 3, line 32, change "A a" to --A--;

Column 3, lines 61-62, change "3 to 5 MHz" to --824 to 894 MHz--;

Column 4, line 22, change "2" to --1--;

UNITED STATES PATENT AND TRADEMARK OFFICE

CERTIFICATE OF CORRECTION

PATENT NO. : 5,148,183

DATED : September 15, 1992

INVENTOR(S) : Aldama

It is certified that error appears in the above-indentified patent and that said Letters Patent is hereby corrected as shown below:

Column 4, line 44, change "3 to 5 MHz" to -- 824 to 894 MHz--;

Signed and Sealed this

Sixteenth Day of August, 1994

Bruce Lehman

*Attest:*

BRUCE LEHMAN

*Attesting Officer*

*Commissioner of Patents and Trademarks*